US009120136B2

(12) United States Patent
Toyoda et al.

(10) Patent No.: US 9,120,136 B2
(45) Date of Patent: Sep. 1, 2015

(54) DRAWING METHOD OF METALLIC TUBE AND PRODUCING METHOD OF METALLIC TUBE USING SAME

(75) Inventors: Masatoshi Toyoda, Tokyo (JP); Keishi Matsumoto, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 285 days.

(21) Appl. No.: 13/703,720

(22) PCT Filed: Jun. 7, 2011

(86) PCT No.: PCT/JP2011/003199

§ 371 (c)(1),
(2), (4) Date: Dec. 12, 2012

(87) PCT Pub. No.: WO2011/158464

PCT Pub. Date: Dec. 22, 2011

(65) Prior Publication Data

US 2013/0086959 A1 Apr. 11, 2013

(30) Foreign Application Priority Data

Jun. 15, 2010 (JP) ..... 2010-135686

(51) Int. Cl.

| | |
|---|---|
| ***B21D 15/06*** | (2006.01) |
| ***B21C 9/00*** | (2006.01) |
| ***B21C 3/14*** | (2006.01) |
| ***C10M 171/02*** | (2006.01) |
| ***C22C 19/03*** | (2006.01) |
| ***C22C 19/05*** | (2006.01) |
| ***C22C 38/40*** | (2006.01) |
| ***C22F 1/10*** | (2006.01) |

(52) U.S. Cl.

CPC ... *B21C 9/00* (2013.01); *B21C 3/14* (2013.01); *B21C 9/005* (2013.01); *C10M 171/02* (2013.01); *C22C 19/03* (2013.01); *C22C 19/05* (2013.01); *C22C 19/058* (2013.01); *C22C 38/40* (2013.01); *C22F 1/10* (2013.01); *C10M 2211/022* (2013.01); *C10M 2211/044* (2013.01); *C10M 2219/022* (2013.01); *C10M 2219/024* (2013.01); *C10M 2219/046* (2013.01); *C10M 2219/08* (2013.01); *C10N 2210/02* (2013.01); *C10N 2210/06* (2013.01); *C10N 2230/02* (2013.01); *C10N 2240/08* (2013.01); *C10N 2240/402* (2013.01); *C10N 2240/403* (2013.01); *C10N 2240/405* (2013.01); *C10N 2240/406* (2013.01); *C10N 2250/10* (2013.01)

(58) Field of Classification Search

CPC ..... B21C 11/00; B21C 3/14; B21C 9/00; B21C 9/005; C22F 1/10; C22C 19/03; C22C 19/058; C22C 38/40; C10M 171/02; C10M 2211/022; C10M 2211/044; C10M 2219/022; C10M 2219/024; C10M 2219/046; C10M 2219/08; C10N 2230/02; C10N 2240/08; C10N 2240/402; C10N 2240/403; C10N 2240/405; C10N 2240/406; C10N 2250/10

USPC ..... 72/39, 41, 42, 43, 49, 47; 508/329, 306, 508/258, 582

See application file for complete search history.

(56) References Cited

U.S. PATENT DOCUMENTS

| | | | | |
|---|---|---|---|---|
| 3,641,795 | A * | 2/1972 | Lester et al. | 72/42 |
| 3,798,943 | A | 3/1974 | Benteler et al. | |
| 4,118,331 | A * | 10/1978 | Jahnke | 72/42 |
| 2006/0270568 | A1 | 11/2006 | Kawata | |
| 2007/0054814 | A1 * | 3/2007 | Negoro et al. | 508/258 |
| 2008/0089803 | A1 * | 4/2008 | Okada et al. | 420/38 |

FOREIGN PATENT DOCUMENTS

| | | |
|---|---|---|
| CN | 1542156 | 11/2004 |
| CN | 1803328 | 7/2006 |
| CN | 101365773 | 2/2009 |
| CN | 101463287 | 6/2009 |
| JP | 62-39045 | 8/1987 |
| JP | 63-215797 | 9/1988 |
| JP | 64-11014 | 1/1989 |
| JP | 01-202313 | 8/1989 |
| JP | 3-18419 | 1/1991 |
| JP | 2003-268503 | 9/2003 |
| JP | 2005-177816 | 7/2005 |
| WO | 03/095693 | 11/2003 |

* cited by examiner

*Primary Examiner* — David B Jones
(74) *Attorney, Agent, or Firm* — Clark & Brody

(57) ABSTRACT

In a drawing method of a metallic tube which includes: filling a high-pressure container with a lubricating oil, the container having a mother tube inserted thereinto; pressurizing the oil with a pressure booster; and drawing the forcedly lubricated mother tube, the oil having a kinetic viscosity of 100 to 2000 $mm^2/s$ at 40° C. and at normal pressure and a viscosity pressure coefficient of 15 to 24 $GPa^{-1}$ at 40° C. is used for preventing seizing and vibrations in drawing and for suppressing the deterioration of surface roughness due to oil pits in tube. Herein, the oil preferably contains one or more of extreme-pressure (EP) additives in a total amount of 10 mass % or more, being selected from a sulfur-based additive, a chlorine-based additive, an organic calcium metallic salt, a phosphorus-based additive, an organic zinc-based additive, and an organic molybdenum-based additive, each having a prescribed amount of relevant element.

12 Claims, No Drawings

DRAWING METHOD OF METALLIC TUBE AND PRODUCING METHOD OF METALLIC TUBE USING SAME

TECHNICAL FIELD

The present invention relates to a drawing method of a metallic tube, by drawing a mother tube which is a material to be worked with the inner and outer surfaces thereof forcedly lubricated, and a producing method of a metallic tube using this drawing method. More specifically, the present invention relates to a drawing method of a metallic tube which can suppress seizing (adhesion) and vibrations/chattering which might occur when a mother tube is subjected to drawing and a producing method of a metallic tube using this drawing method.

Unless otherwise specified, the definition of a term used in this specification is as follows:

"Viscosity pressure coefficient": A coefficient used in Formula (1) below for calculating high-pressure viscosity, which is a kinetic viscosity under high pressure, from normal-pressure viscosity, which is a kinetic viscosity at normal pressure, and the pressure pertinent to the high-pressure viscosity:

$$\eta=\eta_o\exp(\alpha P) \quad (1)$$

where, $\eta$ is high-pressure viscosity at 40° C. ($mm^2/s$), $\eta_o$ is normal-pressure viscosity at 40° C. ($mm^2/s$), $\alpha$ is the viscosity pressure coefficient ($GPa^{-1}$), and P is the pressure pertinent to the high-pressure viscosity $\eta$ (GPa).

BACKGROUND ART

In the cold drawing of a metallic tube, lubrication treatment is performed in order to reduce the friction which occurs due to the contact of a mother tube, which is the material to be worked, with tools such as a die and a plug, thereby preventing the occurrence of seizing and vibrations/chattering. In general, in lubrication treatment, used is a method which involves forming chemical treatment lubrication films on the inner and outer surfaces of a mother tube. However, in obtaining a small-diameter longer-length tube by drawing, the mother tube is generally long enough, and hence in forming chemical treatment lubrication films on the mother tube, attention must be paid to sufficiently apply chemical treatment to the mother tube so as to fully cover the inner surface of the mother tube. For this reason, the treatment requires a large number of man-hours and chemical agents which are used are relatively expensive, resulting in an increase in operating cost.

A metallic tube made of a Ni-based high alloy is in heavy usage as a heat transfer tube in the steam generator of a nuclear power plant. In a mother tube made of a Ni-based high alloy, it is difficult to form chemical treatment lubrication films on the surfaces of the mother tube and, therefore, in the case where a metallic tube made of a Ni-based high alloy is produced by cold drawing, the operating cost required for the forming of chemical treatment lubrication films increases further.

Therefore, the forced lubricating drawing (the high-pressure drawing process) has been developed. The forced lubricating drawing is a kind of cold drawing in which lubrication treatment is directly performed by an oil lubricating film. The forced lubricating drawing stabilizes cold drawing and produces a great effect on the quality improvement in a drawn metallic tube.

Usually, the drawing of a metallic tube by the forced lubricating drawing is carried out by the following procedure:

(1) After filling a high-pressure container with a lubricating oil, the container holding a mother tube, which is a material to be worked and is inserted thereinto, the pressure of the lubricating oil is increased by a pressure booster.

(2) The lubricating oil thus pressurized forms lubricating oil films between the mother tube and tools such as a die and a plug, the die being tightly disposed to an open end of the high-pressure container, the plug being in place in a working position.

(3) With the inner and outer surfaces of the mother tube forcedly lubricated with the formed lubricating oil films, the mother tube is drawn and finished to prescribed dimensions determined by the tools, whereby a metallic tube is obtained.

With respect to drawing by this forced lubricating drawing, various proposals have hitherto been made and for example, there are Patent Literature 1 and Patent Literature 2. Patent Literature 1 relates to a forced lubricating drawing apparatus used in the forced lubricating drawing. The forced lubricating drawing apparatus proposed in Patent Literature 1 comprises: a high-pressure container whose leading end is tightly secured to the back face of the die and which houses the mother tube; a plug supporting bar which is axially movably held in the high-pressure container; and a device which supplies a lubricating oil into the high-pressure container.

A forced lubricating drawing apparatus of such a configuration has such a telescopic construction that a foremost end portion of the high-pressure container can be elongated or shortened axially, while a movable part of the foremost end of the high-pressure container is configured such that the front outside diameter thereof is smaller than the rear inside diameter thereof, with the result that the movable part is able to push the back face of the die by the lubricating oil pressure in the high-pressure container, wherein the whole high-pressure container can be displaced to a mother tube insertion position as being off the drawing line. For this reason, in the drawing method using the forced lubricating drawing apparatus described in Patent Literature 1, it is claimed that a mother tube can be readily and positively subjected to drawing by the forced lubricating drawing.

Patent Literature 2 proposes a method of producing a small-diameter longer-length tube by cold working by use of the forced lubricating drawing in which at least final cold working as involving wall thinning is carried out by plug drawing with a high-pressure lubricating oil of not less than 500 $kgf/cm^3$ in pressure. In Patent Literature 2 it is claimed that at least final cold working as involving wall thinning is performed by the forced lubricating drawing using a high-pressure lubricating oil, whereby dimensional variations along an axial direction of tube can be reduced without the occurrence of seizing in a resultant metallic tube.

In the case where a metallic tube used as a heat transfer tube in a steam generator is produced, in general, inspection by an inner probe type eddy-current flaw detection is conducted for inner surface defects of a metallic tube. In the drawing method of a metallic tube described in Patent Literature 2, it is claimed that because dimensional variations along a tube axial direction of an obtained metallic tube are small enough, the noises caused by dimensional variations of a metallic tube in the inner probe type eddy-current flaw detection is suppressed and hence inner surface defects can be strictly detected on the basis of outputs of a flaw detection device.

Lubrication is performed by forcedly forming lubrication oil films between a mother tube and tools using the drawing method by the forced lubricating drawing described in Patent Literature 1 or 2, whereby in many cases it is possible to prevent the seizing between the tools and the metallic tube. However, the seizing may sometimes occur even when the drawing method by the forced lubricating drawing described in Patent Literature 1 or 2 is used. In addition, in the case where a mother tube made of a Ni-based alloy is subjected to drawing, vibrations/chattering may sometimes occur due to the friction occurring between the plug and the mother tube.

Furthermore, in the drawing by the forced lubricating drawing, in some cases, a lubricating oil is locally trapped on the inner surface of the mother tube and minute recessed portions are formed, resulting in the occurrence of defects called oil pits. If such oil pits are formed in drawing, the inner surface roughness of an obtained metallic tube deteriorates.

On the other hand, with respect to the lubricating oils used in cold drawing, various proposals have hitherto been made, and there is Patent Literature 3, for example. Patent Literature 3 describes a lubrication method in which a wire, a rod or a tube blank made of carbon steel or alloy steel is subjected to acid pickling, a lubricating oil is then applied, and cold drawing is performed. On this occasion, the lubricating oil which is used is a lubricating oil which is adjusted with a thickening agent so that the viscosity becomes 100 to 3000 centipoises at 20° C. by mixing 5 to 40 parts of dialkyl polysulfide containing not less than 30 wt % of sulfur and 20 to 70 parts of one kind or two or more kinds selected from the group consisting of organic compounds containing not less than 15 wt % of sulfur.

In the lubrication method for cold drawing described in Patent Literature 3, it is claimed that by using the above-described lubricating oil, it is possible to perform drawing without the formation of a chemical treatment lubrication film on a material to be worked, that it is possible to reduce the operating cost required by lubrication treatment, and that the surface finish of the material to be worked after drawing is excellent. However, Patent Literature 3 relates to cold drawing which involves applying a lubricating oil at normal pressure and no study is made on the cold drawing by the forced lubricating drawing using a lubricating oil whose pressure is increased.

CITATION LIST

Patent Literature

Patent Literature 1: Japanese Patent Publication No. 62-39045

Patent Literature 2: Japanese Patent Application Publication No. 3-18419

Patent Literature 3: Japanese Patent Application Publication No. 63-215797

Patent Literature 4: Japanese Patent Application Publication No. 1-202313

SUMMARY OF INVENTION

Technical Problem

As described above, in the drawing by the conventional forced lubricating drawing, seizing and vibrations/chattering occur during the drawing of a mother tube and the inner surface roughness deteriorates due to the formation of oil pits, thus posing problems. In addition, for lubricating oils used in the conventional cold drawing, no study is made on the drawing by the forced lubricating drawing using a lubricating oil whose pressure is increased.

The present invention was made in view of such a situation and the object of the invention is to provide a drawing method of a metallic tube capable of preventing seizing and vibrations/chattering which might occur during the drawing of a mother tube and also capable of suppressing deterioration in the inner surface roughness due to the formation of oil pits in the drawing by the forced lubricating drawing.

Solution to Problem

In order to solve the above-described problems, the present inventors conducted various tests and devoted themselves to studies, and as a result, they obtained the finding (a) to (d) below:

(a) In the forced lubricating drawing, the pressure of a lubricating oil filled in a high-pressure container is increased by use of a pressure booster and the lubricating oil is caused to flow forcedly at the interfaces between tools and a mother tube, which is effective in increasing the thickness of the lubricating oil films formed between the tools and the mother tube.

(b) The thickness of the formed lubricating oil films depends on the kinetic viscosity of the lubricating oil.

(c) The lubricating oil retained between the tools and the mother tube has a high pressure because the pressure of the lubricating oil is increased by use of a pressure booster. Therefore, it is necessary to consider the kinetic viscosity under high pressure.

(d) A high-pressure viscosity which is a kinetic viscosity under high pressure is governed by a normal-pressure viscosity which is a kinetic viscosity at normal pressure and the viscosity pressure coefficient.

The present inventors conducted further studies on the basis of the above-described findings and as a result, they found out that by using a lubricating oil in which the normal-pressure viscosity and the viscosity pressure coefficient are adjusted in appropriate ranges in the drawing by the forced lubricating drawing, even in the case where a mother tube made of a high alloy, such as a Ni-based alloy, is subjected to drawing, it is possible to maintain the thickness of lubricating oil films at an appropriate value, it is possible to prevent seizing and vibrations/chattering, and it is possible to suppress the deterioration in the inner surface roughness due to the formation of oil pits.

The present invention was completed on the basis of the above-described findings, and the summaries of the present invention are drawing methods of a metallic tube in (1) to (5) below and a producing method of a metallic tube in (6) below.

(1) A drawing method of a metallic tube which includes: filling a high-pressure container with a lubricating oil, the container having a mother tube inserted thereinto; thereafter increasing the pressure of the lubricating oil by means of a pressure booster; and drawing the mother tube, with the inner and outer surfaces thereof forcedly lubricated, the lubricating oil to be used has a kinetic viscosity in the range of 100 to 2000 $mm^2/s$ at 40° C. and at normal pressure and a viscosity pressure coefficient in the range of 15 to 24 $GPa^{-1}$ at 40° C.

(2) The drawing method of a metallic tube described in (1) above, in which the lubricating oil contains one or more kinds of extreme-pressure additives in a total amount of not less than 10 mass %, the extreme-pressure additives being selected from the group consisting of a sulfur-based extreme-pressure additive containing not less than 2 mass % of sulfur, a chlorine-based extreme-pressure additive containing not less than 5 mass % of chlorine, an organic calcium metallic salt containing not less than 5 mass % of calcium, a phosphorus-based extreme-pressure additive containing not less than 2 mass % of phosphorus, an organic zinc-based extreme-pressure additive containing not less than 2 mass % of zinc, and an organic molybdenum-based extreme-pressure additive containing not less than 2 mass % of molybdenum.

(3) The drawing method of a metallic tube described in (2) above, in which sulfurized oils and fats, ester sulfide, olefin sulfide or polysulfide is used as the sulfur-based extreme-pressure additive, and chlorinated ester, chlorinated oils and fats, chlorinated paraffin containing not less than 12 carbon atoms or calcium sulfonate whose organic calcium metallic salt has total basicities of not less than 100 mg/g KOH is used as the chlorine-based extreme-pressure additive.

(4) The drawing method of a metallic tube described in any of (1) to (3) above, in which the pressure of the lubricating oil is controlled in the range of 40 to 150 MPa in increasing the pressure thereof.

(5) The drawing method of a metallic tube described in any of (1) to (4) above, in which a chemical composition of the mother tube consists of, by mass %, C: not more than 0.15%, Si: not more than 1.00%, Mn: not more than 2.0%, P: not more than 0.030%, S: not more than 0.030%, Cr: 10.0 to 40.0%, Ni: 8.0 to 80.0%, Ti: not more than 0.5%, Cu: not more than 0.6%, Al: not more than 0.5%, and N: not more than 0.20%, the balance being Fe and impurities.

(6) A producing method of a metallic tube, in which the drawing of final finishing is performed by a drawing method of a metallic tube described in any of (1) to (5) above.

Advantageous Effects of Invention

The drawing method of a metallic tube of the present invention has the following remarkable effects:

(1) By using a lubricating oil in which the kinetic viscosity at 40° C. and at normal pressure is adjusted in the range of 100 to 2000 $mm^2/s$ and the viscosity pressure coefficient is adjusted in the range of 15 to 24 $GPa^{-1}$, it is possible to form lubricating oil films having an appropriate thickness between the tools and the mother tube when the mother tube is subjected to drawing.

(2) Thanks to (1) above, it is possible to prevent the seizing and vibrations/chattering which might occur when the mother tube is subjected to drawing.

(3) Thanks to (1) above, it is possible to suppress the deterioration in the inner surface roughness due to the formation of oil pits in an obtained metallic tube.

In the producing method of a metallic tube of the present invention, the drawing of final finishing is performed by the method of drawing of the present invention, it is possible to produce a metallic tube which is free of defects which might be caused by the seizing and vibrations/chattering in drawing and has excellent inner surface roughness.

DESCRIPTION OF EMBODIMENTS

A description will be given below of the drawing method of a metallic tube of the preset invention and the producing method of a metallic tube using the drawing method.

[Drawing Method of Metallic Tube]

The drawing method of a metallic tube of the present invention is such that in a drawing method of a metallic tube which includes: filling a high-pressure container with by a lubricating oil, the container having a mother tube inserted thereinto; thereafter increasing the pressure of the lubricating oil by means of a pressure booster; and drawing the mother tube, with the inner and outer surfaces thereof forcedly lubricated, the lubricating oil to be used has a kinetic viscosity in the range of 100 to 2000 $mm^2/s$ at 40° C. and at normal pressure and a viscosity pressure coefficient in the range of 15 to 24 $GPa^{-1}$ at 40° C.

If the kinetic viscosity of a lubricating oil at 40° C. and at normal pressure (normal pressure viscosity at 40° C.) which is used in drawing is less than 100 $mm^2/s$, it is impossible to form lubricating oil films having a sufficient thickness between the tools and the mother tube, because the high-pressure viscosity decreases even when the viscosity pressure coefficient is increased.

On the other hand, if the kinetic viscosity at 40° C. and at normal pressure is more than 2000 $mm^2/s$, handling at normal pressure becomes difficult because of the high kinetic viscosity. For this reason, troubles may occur when the lubricating oil is supplied and recovered and is circulated between the tank and the high-pressure container, and at the same time, the high-pressure viscosity becomes too high, with the result that the deterioration in the inner surface roughness may become remarkable due to the formation of oil pits in an obtained metallic tube. Furthermore, when the lubricating oil is removed by degreasing from the inner and outer surfaces of a drawn metallic tube, the remnant of oil increases and the degreasibility worsens.

If the viscosity pressure coefficient of a lubricating oil used in drawing is less than 15 $GPa^{-1}$, it is impossible to form lubricating oil films having a sufficient thickness between the tools and the mother tube because the high-pressure viscosity decreases even when the kinetic viscosity at 40° C. and at normal pressure is adjusted in the range of 100 to 2000 $mm^2/s$, and seizing and vibrations/chattering may sometimes occur. On the other hand, if the viscosity pressure coefficient is more than 24 $GPa^{-1}$, the high-pressure viscosity increases even when the kinetic viscosity at 40° C. and at normal pressure is adjusted in the range of 100 to 2000 $mm^2/s$. Therefore, a large number of oil pits are formed in an obtained metallic tube and the inner surface roughness deteriorates.

In the drawing method of a metallic tube of the present invention, lubricating oil films having an appropriate thickness are formed between the tools and the mother tube during drawing by using a lubricating oil whose kinetic viscosity at 40° C. and at normal pressure is adjusted in the range of 100 to 2000 $mm^2/s$ and whose viscosity pressure coefficient at 40° C. is adjusted in the range of 15 to 24 $GPa^{-1}$. As a result of this, in the drawing method of a metallic tube of the present invention, it is possible to prevent the occurrence of seizing and vibrations/chattering during drawing. Furthermore, in the drawing method of a metallic tube of the present invention, it is possible to suppress the deterioration in the inner surface roughness due to the formation of oil pits in an obtained metallic tube and it is also possible to ensure degreasibility.

Even in the case where the normal-pressure viscosity or high-pressure viscosity of a lubricating oil used in drawing is set at a somewhat higher level more than the above-described ranges and lubricating oil films formed during drawing are made excessively thick, it is substantially impossible to obtain lubricating oil films which cause complete separation of interacting surfaces. In this case, oil pits which are locally deep are formed, resulting in a situation in which the inner surface roughness of an obtained metallic tube deteriorates. Therefore, there is also an upper limit to the thickness of a lubricating oil film formed during drawing, i.e., the high-pressure viscosity.

In other words, local direct contact between the tools and the mother tube occurs even when lubricating oil films are made heavily thick. The portion in direct contact can be mitigated only via films which are formed by the extreme-pressure additives contained in a lubricating oil by adsorption and reaction on the surfaces of the tools and the mother tube. The portion in direct contact is called a boundary condition in lubrication.

Therefore, in order to prevent the seizing which might occur in a boundary condition in lubrication, it is preferred that the normal-pressure viscosity and viscosity pressure coefficient of a lubricating oil be adjusted in the above-described ranges specified in the present invention, thereby causing lubricating oil films formed during drawing to have an appropriate thickness and that extreme-pressure additives which readily form films on the surfaces of the tools and the mother tube by adsorption or reaction be used.

In the drawing method of a metallic tube of the present invention, it is preferred that the lubricating oil contain one or more kinds of extreme-pressure additives in a total amount of not less than 10 mass % as being selected from the group consisting of (1) a sulfur-based extreme-pressure additive containing not less than 2 mass % of sulfur, (2) a chlorine-based extreme-pressure additive containing not less than 5 mass % of chlorine, (3) an organic calcium metallic salt containing not less than 5 mass % of calcium, (4) a phosphorus-based extreme-pressure additive containing not less than 2 mass % of phosphorus, (5) an organic zinc-based extreme-pressure additive containing not less than 2 mass % of zinc, and (6) an organic molybdenum-based extreme-pressure additive containing not less than 2 mass % of molybdenum.

The extreme-pressure additives (1) to (6) above readily form films on the surfaces of an alloy steel, such as a Ni-based alloy, by adsorption and reaction. For this reason, by subjecting a mother tube to drawing by use of a lubricating oil containing one or more kinds in a total amount of not less than 10 mass % as being selected from the extreme-pressure additives (1) to (6) above, it is possible to prevent the seizing which may occur in the boundary condition in lubrication. In the drawing method of a metallic tube of the present invention, as shown in the embodiments which will be described later, it is possible to use a lubricating oil which contains one or more kinds of extreme-pressure additives in a total amount of 100 mass % as being selected from the extreme-pressure additives (1) to (6) above.

As the extreme-pressure additives (1) to (6) above, in specific examples the following can be adopted:

(1) It is possible to adopt sulfurized oils and fats, ester sulfide, olefin sulfide, polysulfide, thiocarbonates, dithiazoles, polythiazoles, thiols, thiocarboxylates, chiokols, sulfur sodium (poly) sulfide as the sulfur-based extreme-pressure additive containing not less than 2 mass % of sulfur. In the drawing method of a metallic tube of the present invention, it is preferable to use sulfurized oils and fats, ester sulfide, olefin sulfide or polysulfide, which have a great effect of preventing seizing.

(2) It is possible to adopt chlorinated ester, chlorinated oils and fats, chlorinated paraffin containing not less than 12 carbon atoms, polyvinylidene chloride, polyvinyl chloride or vinylidene chloride-acrylic copolymers as the chlorine-based extreme-pressure additive containing not less than 5 mass % of chlorine. In the drawing method of a metallic tube of the present invention, it is preferable to use chlorinated ester, chlorinated oils and fats, chlorinated paraffin containing not less than 12 carbon atoms or calcium sulfonate whose organic calcium metallic salt has total basicities of not less than 100 mg/g KOH, which have a great effect of preventing seizing.

(3) It is possible to adopt calcium sulfonate, calcium fenate calcium salicylate, or calcium carboxylate the organic calcium metallic salt of which has total basicities of not less than 100 mg/g KOH as the organic calcium metallic salt containing not less than 5 mass % of calcium.

(4) It is possible to adopt condensed phosphates, such as sodium tripolyphosphate, and phosphoric (phosphite) esters, such as tricresyl phosphate as the phosphorus-based extreme-pressure additive containing not less than 2 mass % of phosphorus.

(5) It is possible to adopt zinc dialkyl dithio phosphates and zinc dialkyl dithio calbamates as the organic zinc-based extreme-pressure additive containing not less than 2 mass % of zinc.

(6) It is possible to adopt molybdenum dialkyl dithio calbamates or molybdenum dialkyl dithio phosphates as the organic molybdenum-based extreme-pressure additive containing not less than 2 mass % of molybdenum.

In the drawing method of a metallic tube of the present invention, it is preferred that the pressure of the lubricating oil be 40 to 150 MPa in increasing the pressure of the lubricating oil. If the pressure of the lubricating oil filled in the high-pressure container is less than 40 MPa, lubricating oil films having a sufficient thickness are not formed between the tools and the mother tube and there is apprehension that seizing and vibrations/chattering might occur. On the other hand, if the pressure of the lubricating oil is more than 150 MPa, this gives an excessive load to the drawing apparatus; in addition, in an obtained metallic tube, the inner surface roughness may decrease due to the formation of oil pits. It is more preferred that the pressure of the lubricating oil be not less than 50 MPa.

[Chemical Composition of Mother Tube]

In the drawing method of a metallic tube of the present invention, it is preferable to use a mother tube whose chemical composition consists of, by mass %, C: not more than 0.15%, Si: not more than 100%, Mn: not more than 2.0%, P: not more than 0.030%, S: not more than 0.030%, Cr: 10.0 to 40.0%, Ni: 8.0 to 80.0%, Ti: not more than 0.5%, Cu: not more than 0.6%, Al: not more than 0.5%, and N: not more than 0.20%, the balance being Fe and impurities.

Here, impurities are components which mix in from ores, scraps and the like when a mother tube is industrially produced and are allowed so long as these elements do not have an adverse effect on the present invention. Each element will be described below.

C: Not more than 0.15%

If the content of carbon (C) is more than 0.15%, stress corrosion cracking resistance may deteriorate. Therefore, in the case where C is added, the C content is preferably not more than 0.15%, more preferably not more than 0.06%. Incidentally, C has the effect of increasing the grain boundary strength of alloys. In order to obtain this effect, it is preferred that the C content be not less than 0.01%.

Si: Not more than 1.00%

Silicon (Si) is used as a deoxidizer during steel-making and refining and remains as an impurity in alloys. At this time, it is preferred that the Si content be limited to not more than 1.00%. Because the cleanliness of alloys may sometimes decrease if the Si content is more than 0.50%, it is more preferred that the Si content be limited to not more than 0.50%.

Mn: Not more than 2.0%

Manganese (Mn) immobilizes an impurity element S as MnS and improves hot workability, but is an element effective as a deoxidizer. Because the cleanliness of alloys reduces if the Mn content is more than 2.0%, it is preferred that the Mn content be not more than 2.0%. More preferably, the Mn content is not more than 1.0%. When the effect of improving hot workability by Mn is to be obtained, it is preferred that the Mn content is not less than 0.1%.

P: Not more than 0.030%

Phosphorus (P) is an element present in alloys as an impurity and may sometimes have an adverse effect on corrosion resistance if the P content is more than 0.030%. Therefore, it is preferred that the P content be limited to not more than 0.030%.

S: Not more than 0.030%

Sulfur (S) is an element present in alloys as an impurity and may sometimes have an adverse effect on corrosion resistance if the S content is more than 0.030%. Therefore, it is preferred that the S content be limited to not more than 0.030%.

Cr: 10.0 to 40.0%

Chromium (Cr) is an element necessary for maintaining the corrosion resistance of alloys and it is preferred that the Cr content is not less than 10.0%. However, if the Cr content is more than 40.0%, the Ni content becomes low relatively and this may reduce the corrosion resistance and hot workability of alloys. Therefore, it is preferred that the Cr content be 10.0 to 40.0%. In particular, when the content of Cr is 14.0 to 17.0%, a metal is excellent in corrosion resistance in an environment containing chlorides, while when the content of Cr is 27.0 to 31.0%, a metal is excellent in corrosion resistance further in pure water at high temperatures and in an alkaline environment.

Ni: 8.0 to 80.0%

Nickel (Ni) is an element necessary for ensuring the corrosion resistance of alloys and it is preferred that the content of Ni is not less than 8.0%. On the other hand, because Ni is expensive, the content of Ni needs to be just necessary minimum amounts as required, and it is preferred that the Ni content be not more than 80.0%.

Ti: Not more than 0.5%

If the titanium (Ti) content is more than 0.5%, the cleanliness of alloys may be deteriorated. Therefore, it is preferred that the Ti content be not more than 0.5%, and more preferably, the Ti content is not more than 0.4%. However, from the viewpoints of an increase in the workability of alloys and the suppression of grain growth during welding operation, it is preferred that the content of Ti is not less than 0.1%.

Cu: Not more than 0.6%

Copper (Cu) is an element present in alloys as an impurity and the corrosion resistance of alloys may sometimes decrease if the Cu content is more than 0.6%. Therefore, it is preferred that the Cu content be limited to not more than 0.6%.

Al: Not more than 0.5%

Aluminum (Al) is used as a deoxidizer during steelmaking and remains as an impurity in alloys. Remaining Al becomes oxide-based inclusions in alloys, deteriorates the cleanliness of the alloys, and may sometimes have an adverse effect on the corrosion resistance and mechanical properties of the alloys. Therefore, it is preferred that the Al content be limited to not more than 0.5%.

N: Not more than 0.20%

Although Nitrogen (N) may not be added, in Ni-based alloys which are preferably used in a mother tube in the present invention, usually N is contained as an impurity in amounts of about 0.01%. However, if Ni is positively added, it is possible to increase strength without deteriorating corrosion resistance. However, because corrosion resistance decreases if the content of N is more than 0.20%, it is preferable that the upper limit of the content of N is 0.20%.

In the drawing method of a metallic tube of the present invention, it is preferable to adopt in particular a Ni-based alloy having the following chemical composition as the Ni-based alloy used in the mother tube because better corrosion resistance is obtained: C: not more than 0.15%, Si: not more than 1.00%, Mn: not more than 2.0%, P: not more than 0.030%, S: not more than 0.030%, Cr: 10.0 to 40.0%, Fe: not more than 15.0%, Ti: not more than 0.5%, Cu: not more than 0.6%, and Al: not more than 0.5%, the balance being Fe and impurities.

Typical Ni-based alloys of the above-described chemical composition which are preferably used in the mother tube include the following two kinds:

(a) A Ni-based alloy consisting of: C: not more than 0.15%, Si: not more than 1.00%, Mn: not more than 2.0%, P: not more than 0.030%, S: not more than 0.030%, Cr: 14.0 to 17.0%, Fe: 6.0 to 10.0%, Ti: not more than 0.5%, Cu: not more than 0.6%, and Al: not more than 0.5%, the balance being Ni and impurities.

(b) A Ni-based alloy consisting of: C: not more than 0.06%, Si: not more than 1.00%, Mn: not more than 2.0%, P: not more than 0.030%, S: not more than 0.030%, Cr: 27.0 to 31.0%, Fe: 7.0 to 11.0%, Ti: not more than 0.5%, Cu: not more than 0.6%, and Al: not more than 0.5%, the balance being Ni and impurities.

The alloy (a) above is an alloy excellent in corrosion resistance in environments containing chlorides because the alloy contains Cr: 14.0 to 17.0% and contains Ni of about 75%. In this alloy, from the standpoint of balance between the Ni content and the Cr content, it is preferred that the Fe content be 6.0 to 10.0%.

The alloy (b) above is an alloy excellent in corrosion resistance not only in environments containing chlorides, but also in pure water at high temperatures and alkaline environments because the alloy contains Cr: 27.0 to 31.0% and contains Ni of about 60%. Also in this alloy, from the standpoint of balance between the Ni content and the Cr content, it is preferred that the Fe content be 7.0 to 11.0%.

[Producing Method of Metallic Tube]

In the production of a metallic tube, in general, a mother tube is subjected to drawing a plurality of times, whereby a metallic tube of prescribed dimensions and surface properties is produced. The drawing method of a metallic tube of the present invention has the feature that the drawing of final finishing is performed by the drawing method of the present invention. As a result of this, the occurrence of seizing and vibrations/chattering in the drawing of final finishing is prevented and the deterioration in the inner surface roughness due to the formation of oil pits is suppressed. Therefore, in the producing method of a metallic tube of the present invention, it is possible to produce a metallic tube which is free of defects to be caused by the seizing and vibrations/chattering in the drawing and has excellent inner surface roughness.

EXAMPLES

Tests which involve subjecting mother tubes to cold drawing were conducted by the drawing method of a metallic tube of the present invention and the producing method of a metallic tube using the drawing method, and the effects of the present invention was verified.

[Test Method]

A high-pressure container with a mother tube being inserted thereinto was filled by a lubricating oil, thereafter the pressure of the lubricating oil was increased by means of a pressure booster, and the mother tube was subjected to drawing, with the inner and outer surfaces thereof forcedly lubricated, whereby a metallic tube was obtained. The obtained metallic tube was degreased by being immersed for 30 minutes in an alkaline degreasing solution held at 70° C., the solution consisting of sodium hydride (caustic soda) and a surfactant. Drawing was performed using a forced lubricating device having the same mechanism as the high-pressure drawing device disclosed in Patent Literature 4.

The test conditions are as follows.

Details on mother tube:

Size before drawing: Outside diameter 25 mm, wall thickness 1.65 mm, length 10 m Roughness of inner and outer surfaces before drawing: Ra 0.3 μm (Ra: Arithmetic average value (JIS B0601-2001))

Material grade: Ni-based alloy in accordance with ASME SB-163 UNS N06690

(Typical composition: 30 mass % Cr-60 mass % Ni-10 mass % Fe)

Drawing: Material grade of die; Superalloy

Material grade of plug; Superalloy coated with alumina

Drawing speed; 15 m/min

Temperature of lubricating oil; 50° C.

Details on product metallic tube:

Size after drawing: Outside diameter; 19 mm, wall thickness; 1.13 mm

The above-described superalloy of the die and plug is an alloy consisting of tungsten carbide and a metal, which is classified as the material symbol HW in Table 1 of JIS B4053.

Table 1 shows the typical compositions, kinetic viscosities at 40° C. and at normal pressure and viscosity pressure coefficients of lubricating oils used in this test. The kinetic viscosities at 40° C. and at normal pressure shown in Table 1 were measured in accordance with JIS K2283. The viscosity pressure coefficients were found from high-pressure viscosities measured using a falling sphere viscometer for high-pressure viscosity and the above-described kinetic viscosities at 40° C. and at normal pressure with the aid of Formula (1) above.

TABLE 1

| Conditions | Symbol | Typical composition | Viscosity at 40° C. and at normal pressure ($mm^2/s$) | Viscosity pressure coefficient ($GPa^{-1}$) |
|---|---|---|---|---|
| Inventive Example of present invention | A | Mixed naphthene-based mineral oil | 110 | 15.5 |
| | B | Mixed naphthene-based mineral oil | 1900 | 21.8 |
| | C | Mixed naphthene-based mineral oil 90 mass %<br>Sulfurized oils and fats 10 mass % | 500 | 16.0 |
| | D | Mixed naphthene-based mineral oil 90 mass %<br>Long-chain chlorinated paraffin 10 mass % | 1000 | 21.0 |
| | E | Mixed naphthene-based mineral oil 88 mass %<br>Tricresyl phosphate 3 mass %<br>Zinc dialkyl dithio phosphate 3 mass %<br>Calcium sulfonate 3 mass %<br>Molybdenum dialkyl dithio calbamate 3 mass % | 1000 | 18.0 |
| | F | Sulfurized oils and fats 60 mass %<br>Long-chain chlorinated paraffin 20 mass %<br>Chlorinated ester 20 mass % | 500 | 21.0 |
| | G | High-viscosity naphthene-based mineral oil 40 mass %<br>Sulfurized oils and fats 30 mass %<br>Long-chain chlorinated paraffin 30 mass % | 1050 | 23.5 |
| Comparative Example | H | Low-viscosity naphthene-based mineral oil | 50 | 14.0 |
| | I | High-viscosity naphthene-based mineral oil 90 mass %<br>Long-chain chlorinated paraffin 10 mass % | 2200 | 25.0 |
| | J | Synthetic fatty acid ester oil | 1500 | 10.5 |
| | K | Low-viscosity naphthene-based mineral oil | 80 | 16.5 |
| | L | High-viscosity naphthene-based mineral oil 70 mass %<br>High-molecular synthetic hydrocarbon 30 mass % | 1200 | 26.0 |

In the lubricating oils A to G shown in Table 1, the kinetic viscosities at 40° C. and at normal pressure and the viscosity pressure coefficients are in the range specified in the present invention, whereas in the lubricating oils H to L, either or both of the kinetic viscosities at 40° C. and at normal pressure and the viscosity pressure coefficients are out of the range specified in the present invention.

Table 2 shows the lubricating oils used in each test, the pressures of the lubricating oils filled in the high-pressure container which were obtained by using the pressure booster, and the evaluation results of seizing, vibrations/chattering, inner surface roughness and degreasibility.

TABLE 2

| Division | | Test conditions | | Test results | | | |
|---|---|---|---|---|---|---|---|
| Conditions | Test No. | Lubricating oils used | Pressure of lubricating oil (MPa) | Seizing | Vibrations/ chattering | Inner surface roughness | Degreasibility |
| Inventive | 1 | A | 120 | ◎ | ◎ | ◎ | ◎ |
| Example of | 2 | B | 120 | ◎ | ◎ | ◎ | ◎ |
| present | 3 | C | 120 | ◎ | ◎ | ◎ | ◎ |

TABLE 2-continued

| Division | | Test conditions | | Test results | | | |
|---|---|---|---|---|---|---|---|
| Conditions | Test No. | Lubricating oils used | Pressure of lubricating oil (MPa) | Seizing | Vibrations/ chattering | Inner surface roughness | Degreasibility |
| invention | 4 | D | 120 | ◎ | ◎ | ◎ | ◎ |
| | 5 | E | 120 | ◎ | ◎ | ◎ | ◎ |
| | 6 | F | 120 | ◎ | ◎ | ◎ | ◎ |
| | 7 | C | 40 | ◎ | ◎ | ◎ | ◎ |
| | 8 | C | 150 | ◎ | ◎ | ◎ | ◎ |
| | 9 | C | 20 | ○ | ◎ | ◎ | ◎ |
| | 10 | C | 160 | ◎ | ◎ | ○ | ○ |
| | 11 | G | 120 | ◎ | ◎ | ○ | ○ |
| Comparative example | 12 | H | 120 | X | X | ○ | ◎ |
| | 13 | I | 120 | ◎ | ◎ | Δ | X |
| | 14 | J | 120 | X | X | ○ | Δ |
| | 15 | K | 120 | X | X | ○ | ◎ |
| | 16 | L | 120 | ◎ | ◎ | X | ○ |

[Evaluation Criteria]

In each test, occurrence of the seizing and vibrations/chattering during drawing, as well as the inner surface roughness and degreasibility of metallic tubes obtained after drawing were evaluated.

The evaluation of seizing was carried out by visually observing the metallic tubes obtained after drawing and the tools which were used. The meanings of the symbols of the "Seizing" column in the test results of Table 2 are as follows:

◎: The symbol indicates that neither linear flaws in a metallic tube nor even a trace of tarnish in the tools were observed.

○: The symbol indicates that slight but tolerable tarnish was observed in the tools.

Δ: The symbol indicates that slight linear flaws were observed in a metallic tube.

x: The symbol indicates that linear flaws due to seizing were observed in a metallic tube and that the metallic tube was a product defective.

The evaluation of vibrations/chattering was carried out by ascertaining whether unusual noises were generated during drawing. The meanings of the symbols of the "Vibrations/chattering" column in the test results of Table 2 are as follows:

◎: The symbol indicates that the generation of vibrations/chattering was not observed during drawing.

○: The symbol indicates that occurrence of vibrations/chattering was observed partially during drawing.

x: The symbol indicates that occurrence of vibrations/chattering was wholly observed during drawing.

The evaluation of the inner surface roughness was carried out by measuring the arithmetic average roughness Ra (JIS B0601-2001) of the inner surface of the metallic tube. The meanings of the symbols of the "Inner surface roughness" column in the test results of Table 2 are as follows:

◎: The symbol indicates that Ra is less than 0.5 μm.

○: The symbol indicates that Ra is not less than 0.5 μm and is less than 1.0 μm.

Δ: The symbol indicates that Ra is not less than 1.0 μm and is less than 1.6 μm.

x: The symbol indicates that Ra is not less than 1.6 μm.

For the evaluation of degreasibility, the oil portion remaining on the inner surface of a degreased metallic tube was measured by the resistance heating furnace-infrared absorption technique (RC612 made by LECO) and evaluated as the amount of deposited carbon. The meanings of the symbols of the "Degreasibility" column in the test results of Table 2 are as follows:

◎: The symbol indicates that the amount of deposited carbon is less than 20 $mg/m^2$.

○: The symbol indicates that the amount of deposited carbon is not less than 20 $mg/m^2$ and less than 50 $mg/m^2$.

Δ: The symbol indicates that the amount of deposited carbon is not less than 50 $mg/m^2$ and less than 100 $mg/m^2$.

x: The symbol indicates that the amount of deposited carbon is not less than 100 $mg/m^2$.

[Test Results]

From the test results shown in Table 2, in the Inventive Examples 1 to 11 of the present invention, in all of the tests, the lubricating oils used were such that the kinetic viscosity at 40° C. and at normal pressure was in the range of 100 to 2000 $mm^2/s$ and the viscosity pressure coefficient was in the range of 15 to 24 $GPa^{-1}$. For the evaluations of seizing, vibrations/chattering, inner surface roughness, and degreasibility, the evaluation results were ◎: or ○, which is good.

On the other hand, in the Comparative Examples 12, 14 and 15, the lubricated oils used were such that either or both of the kinetic viscosity at 40° C. and at normal pressure and the viscosity pressure coefficient were smaller than the ranges specified in the present invention. Therefore, it was impossible to form lubricating oil films having a sufficient thickness between the tools and the mother tube during drawing and the evaluation results of seizing and vibrations/chattering went down to x.

In the Comparative Example 16, the lubricating oil used was such that the viscosity pressure coefficient was larger than the range specified in the present invention and it was possible to form lubricating oil films having a sufficient thickness between the tools and the mother tube during drawing. Therefore, the evaluation results of seizing and vibrations/chattering were ◎: but due to the formation of oil pits the evaluation result of inner surface roughness went down to x and the evaluation of the degreasibility result went down to ○. In the Comparative Example 13, the lubricating oil used was such that the kinetic viscosity at 40° C. and at normal pressure was larger than the range specified in the present invention in addition to the viscosity pressure coefficient. Therefore, the evaluation result of inner surface roughness went down to Δ and in addition, the evaluation result of the degreasibility also went down to x.

Therefore, it could be ascertained that when the kinetic viscosity at 40° C. and at normal pressure and the viscosity pressure coefficient satisfy the ranges specified in the present invention, lubricating oil films having a sufficient thickness are formed between the tools and the mother tube during drawing, with the result that the occurrence of seizing and vibrations/chattering is reduced, that the deterioration in the inner surface roughness due to the formation of oil pits is suppressed in an obtained metallic tube, and that degreasibility is ensured.

In the Inventive Examples 1 and 2 of the present invention, the lubricating oils used A and B did not contain the extreme-pressure additives specified in the present invention, and the evaluation results of seizing, vibrations/chattering, inner surface roughness, and degreasibility were ◎: or ○. On the other hand, in the Inventive Examples 3 to 6 of the present invention, the lubricating oils used C to F contained the extreme-pressure additives specified in the present invention in total amounts of not less than 10 mass %, and the evaluation results of seizing, vibrations/chattering, inner surface roughness, and degreasibility were all ◎:. In the Inventive Example 6 of the present invention, the lubricating oil used F contained the extreme-pressure additives in a total amount of 100 mass %, and the evaluation results of seizing, vibrations/chattering, inner surface roughness, and degreasibility were all ◎: From this, it could be ascertained that in the drawing method of a metallic tube of the present invention, it is preferable to use a lubricating oil containing the extreme-pressure additives specified in the present invention in a total amount of not less than 10 mass %.

In the Inventive Examples 3 and 8 to 10 of the present invention, changes were made to only the pressures of the lubricating oils filled in the high-pressure container which were obtained by using the pressure booster. In the Inventive Examples 3, 7 and 8 of the present invention, the pressure of the lubricating oils was set in the range of 40 to 150 MPa, and the evaluation results of seizing, vibrations/chattering, inner surface roughness, and degreasibility were all ◎: .

On the other hand, in the Inventive Example 9 of the present invention, the pressure of the lubricating oil was reduced to as small as 20 MPa, which was less than 40 MPa, and the evaluation result of seizing went down to ○. In the Inventive Example 10 of the present invention, the pressure of the lubricating oil was increased to as large as 160 MPa, which exceeded 150 MPa, and the evaluation results of inner surface roughness and degreasibility went down to ○. From this, it could be ascertained that in the drawing method of a metallic tube of the present invention, in increasing the pressure of a lubricating oil filled in the high-pressure container, it is preferable to control the pressure of the lubricating oil in the range of 40 to 150 MPa.

Like the lubricating oils C to F, the lubricating oil G contains the extreme-pressure additives specified in the present invention in a total amount of not less than 10 mass %, but the kinetic viscosity at 40° C. and at normal pressure and the viscosity pressure coefficient are high compared to the lubricating oils C to F. As a result of this, in the Inventive Examples 3 to 6 of the present invention in which the lubricating oils C to F were used, as described above the evaluation results of seizing, vibrations/chattering, inner surface roughness, and degreasibility were all ◎:, whereas in the Inventive Example 11 of the present invention in which the lubricating oil G was used, the evaluation results of seizing and vibrations/chattering became ◎: and the evaluation results of inner surface roughness and degreasibility became ○.

From the foregoing, it became apparent that in the drawing method of a metallic tube of the present invention, by using a lubricating oil whose kinetic viscosity at 40° C. and at normal pressure is adjusted in the range of 100 to 2000 $mm^2/s$ and whose viscosity pressure coefficient is adjusted in the range of 15 to 24 $GPa^{-1}$, lubricating oil films having an appropriate thickness are formed between the tools and the mother tube during the drawing of the mother tube, with the result that the occurrence of seizing and vibrations/chattering can be reduced, that the deterioration in the inner surface roughness due to the formation of oil pits can be suppressed in an obtained metallic tube, and that degreasibility can be ensured.

INDUSTRIAL APPLICABILITY

The drawing method of a metallic tube of the present invention has the following remarkable effects:

(1) By using a lubricating oil whose kinetic viscosity at 40° C. and at normal pressure is adjusted in the range of 100 to 2000 $mm^2/s$ and whose viscosity pressure coefficient is adjusted in the range of 15 to 24 $GPa^{-1}$, lubricating oil films having an appropriate thickness are formed between the tools and the mother tube during the drawing of the mother tube.

(2) Thanks to (1) above, it is possible to prevent the seizing and vibrations/chattering which might occur during the drawing of the mother tube.

(3) Thanks to (1) above, it is possible to suppress the deterioration in the inner surface roughness due to the formation of oil pits in an obtained metallic tube.

Because in the method of manufacturing a metallic tube of the present invention, drawing as the final finishing is performed by the drawing method of a metallic tube of the present invention, it is possible to produce a metallic tube which is free of defects caused by seizing and vibrations/chattering in drawing and has excellent inner surface roughness.

Therefore, it is possible to provide a metallic tube suitable for the heat transfer tube of a steam generator of a nuclear power plant by applying the drawing method of a metallic tube of the present invention and the producing method of a metallic tube used in this drawing method to the production of a metallic tube.

What is claimed is:

1. A drawing method of a metallic tube which includes:

filling a high-pressure container with a lubricating oil, the container having a mother tube inserted thereinto;

thereafter increasing the pressure of the lubricating oil by means of a pressure booster; and drawing the mother tube, with inner and outer surfaces thereof forcedly lubricated, wherein the lubricating oil to be used has a kinetic viscosity in the range of 100 to 2000 $mm^2/s$ at 40° C. and at normal pressure and a viscosity pressure coefficient in the range of 15 to 24 $GPa^{-1}$ at 40° C., and wherein a chemical composition of the mother tube consists of, by mass %, C: not more than 0.15%, Si: not more than 1.00%, Mn: not more than 2.0%, P: not more than 0.030%, S: not more than 0.030%, Cr: 10.0 to 40.0%, Ni: 8.0 to 80.0%, Ti: not more than 0.5%, Cu: not more than 0.6%, Al: not more than 0.5% and N: not more than 0.20%, the balance being Fe and impurities.

2. The drawing method of a metallic tube according to claim 1, wherein the lubricating oil contains one or more kinds of extreme-pressure additives in a total amount of not less than 10 mass %, the extreme-pressure additives being selected from the group consisting of a sulfur-based extreme-pressure additive containing not less than 2 mass % of sulfur, a chlorine-based extreme-pressure additive containing not less than 5 mass % of chlorine, an organic calcium metallic salt containing not less than 5 mass % of calcium, a phosphorus-based extreme-pressure additive containing not less than 2 mass % of phosphorus, an organic zinc-based extreme-pressure additive containing not less than 2 mass % of zinc, and an organic molybdenum-based extreme-pressure additive containing not less than 2 mass % of molybdenum.

3. The drawing method of a metallic tube according to claim 2, wherein the pressure of the lubricating oil is controlled in the range of 40 to 150 MPa in increasing the pressure thereof.

4. The drawing method of a metallic tube according to claim 2, wherein sulfurized oils and fats, ester sulfide, olefin sulfide or polysulfide is used as the sulfur-based extreme-pressure additive, and chlorinated ester, chlorinated oils and fats, chlorinated paraffin containing not less than 12 carbon atoms or calcium sulfonate whose organic calcium metallic salt has total basicities of not less than 100 mg/g KOH is used as the chlorine-based extreme-pressure additive.

5. The drawing method of a metallic tube according to claim 4, wherein the pressure of the lubricating oil is controlled in the range of 40 to 150 MPa in increasing the pressure thereof.

6. The drawing method of drawing a metallic tube according to claim 1, wherein the pressure of the lubricating oil is controlled in the range of 40 to 150 MPa in increasing the pressure thereof.

7. A producing method of a metallic tube, wherein the drawing of final finishing is performed by a drawing method of a metallic tube according to claim 1.

8. A producing method of a metallic tube, wherein the drawing of final finishing is performed by a drawing method of a metallic tube according to claim 2.

9. A producing method of a metallic tube, wherein the drawing of final finishing is performed by a drawing method of a metallic tube according to claim 4.

10. A producing method of a metallic tube, wherein the drawing of final finishing is performed by a drawing method of a metallic tube according to claim 6.

11. A producing method of a metallic tube, wherein the drawing of final finishing is performed by a drawing method of a metallic tube according to claim 3.

12. A producing method of a metallic tube, wherein the drawing of final finishing is performed by a drawing method of a metallic tube according to claim 5.

* * * * *